US006608268B1

(12) United States Patent
Goldsmith

(10) Patent No.: US 6,608,268 B1
(45) Date of Patent: Aug. 19, 2003

(54) PROXIMITY MICRO-ELECTRO-MECHANICAL SYSTEM

(75) Inventor: Charles L. Goldsmith, Plano, TX (US)

(73) Assignee: MEMtronics, a division of Cogent Solutions, Inc., Plano, TX (US)

( * ) Notice: Subject to any disclaimer, the term of this patent is extended or adjusted under 35 U.S.C. 154(b) by 0 days.

(21) Appl. No.: 10/068,399

(22) Filed: Feb. 5, 2002

(51) Int. Cl.[7] ..... H01H 57/00
(52) U.S. Cl. ..... 200/181; 200/267
(58) Field of Search ..... 200/181, 257, 200/512, 269; 335/78; 257/780

(56) References Cited

U.S. PATENT DOCUMENTS 4,480,162 A * 10/1984 Greenwood ..... 200/181
4,959,515 A * 9/1990 Zavracky et al. ..... 200/181
5,258,591 A * 11/1993 Buck ..... 200/181
5,278,368 A * 1/1994 Kasano et al. ..... 200/181
5,619,061 A 4/1997 Goldsmith et al.
5,638,946 A * 6/1997 Zavracky ..... 200/181
5,677,823 A * 10/1997 Smith ..... 361/234
6,046,659 A * 4/2000 Loo et al. ..... 333/262
6,057,520 A * 5/2000 Goodwin-Johansson .... 200/181
6,094,116 A * 7/2000 Tai et al. ..... 335/78
6,100,477 A 8/2000 Randall et al.
6,153,839 A * 11/2000 Zavracky et al. ..... 200/181
6,310,339 B1 * 10/2001 Hsu et al. ..... 250/214.1
6,384,353 B1 * 5/2002 Huang et al. ..... 200/181
6,440,767 B1 * 8/2002 Loo et al. ..... 438/52
6,483,056 B2 * 11/2002 Hyman et al. ..... 200/181
6,483,395 B2 * 11/2002 Kasai et al. ..... 333/105

* cited by examiner

*Primary Examiner*—Elvin Enad
*Assistant Examiner*—Lisa N Klaus
(74) *Attorney, Agent, or Firm*—Carr LLP

(57) ABSTRACT

A proximity micro-electro-mechanical system (MEMS) utilizing a gaseous capacitive gap between two conductive members. The gaseous gap is maintained by insulating structures that prevent the two conductive members from shorting. Once actuated, the gaseous gap allows high-frequency signals to be transmitted between the two conductive members.

44 Claims, 5 Drawing Sheets

PROXIMITY MICRO-ELECTRO-MECHANICAL SYSTEM

BACKGROUND OF THE INVENTION

1. Field of the Invention

The invention relates generally to electronic switches, and, more particularly, to capacitive micro-electro-mechanical system (MEMS) switches.

2. Description of Related Art

Capacitive MEMS may be used in RF switches, phase arrays, phase scanning, compensating circuits, filters, beam matrices, channel switching, and the like. Generally, capacitive switches typically operate by suspending a flexible, conductive membrane over a dielectric layer, which is coupled to at least one electrode. In a normal "OFF" state, that is, when no DC voltage is applied to the electrode, the conductive membrane is suspended without touching the dielectric layer. In an "ON" state, that is, when a voltage is applied to the electrode, however, the conductive membrane is "pulled down" to the dielectric layer, which produces an increased capacitance allowing high-frequency signals to be transmitted between the conductive membrane and the electrode.

Capacitive switches, however, experience a dielectric charging when the flexible, conductive membrane has a high voltage on it, and comes in contact with the dielectric layer. While this dielectric layer gives the switch a desirable on-capacitance (due to its high relative dielectric constant), this layer also experiences a dielectric-charging phenomenon, which limits the life expectancy of the switch. For example, with 50 volts across a 0.2 micron thick dielectric layer, an electric field of 2.5 MV/cm is present across the dielectric layer. It has been shown that electric fields on the order of 1–5 MV/cm cause quantum-mechanical tunneling of charges into the dielectric. These charges become trapped within the dielectric layer due to its insulating properties. Over time and actuations, these charges build up a voltage that screens (subtracts) from the applied field, ultimately causing the switch to stick in the down position, or not actuate when desired. At this point, the switch has failed. Proper operation of the switch cannot resume until these charges have slowly bled off, which can take from days to weeks, depending on the purity and conductivity of the dielectric layer.

Therefore, there is a need for a capacitive MEMS switch that prevents the storing of charges in the dielectric layer, thereby increasing reliability and the life expectancy of the switch.

SUMMARY

The present invention provides a proximity micro-electro-mechanical system (MEMS) device that utilizes a gaseous capacitive gap. The MEMS comprises a second electrode suspended above at least one first electrode. At least one insulating support prevents at least a portion of the second electrode from contacting at least a portion of the first electrode, maintaining the gaseous capacitive gap. When voltage is applied to the electrode, the flexible membrane is drawn towards the electrode and charges the gaseous capacitive gap.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION

Figure 1:
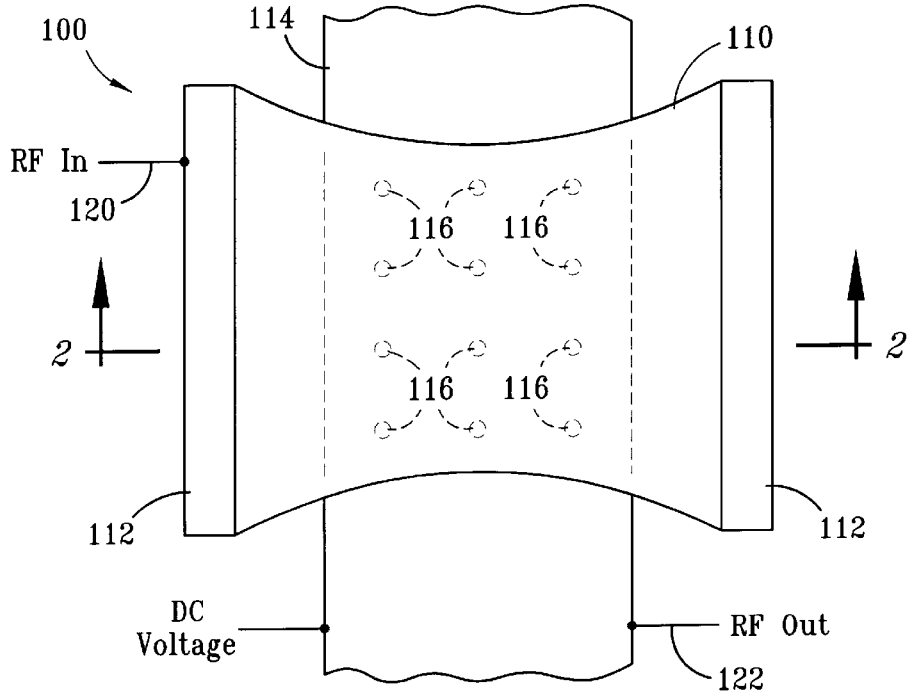
FIG. 1 illustrates a MEMS embodying features of the present invention.

Referring to FIG. 1 of the drawings, the reference numeral 100 generally designates a top view of a MEMS switch embodying features of the present invention. The MEMS switch 100 generally comprises a flexible membrane 110 suspended by supports or posts 112 over at least one electrode 114. The flexible membrane 110 and the electrode 114 are preferably constructed from a conductive material, such as aluminum, gold, copper, platinum, nickel, or the like, such that when a voltage, such as a direct-current (DC) voltage, an alternating-current (AC) voltage, a radio-frequency (RF) voltage, or the like, but preferably a DC voltage, is applied to either the flexible membrane 110 or the electrode 114, the flexible membrane 110 is attracted to, i.e., pulled-down to, the electrode 114. In this actuated state, signals are allowed to be transmitted between the flexible membrane 110 and the electrode 114, such as from the RF In 120 to the RF Out 122.

As will be discussed in greater detail below with reference to FIGS. 2 and 3, one or more insulating structures or posts 116 are positioned to prevent the flexible membrane 110 from contacting the electrode 114. Preferably, the insulating structures 116 are constructed from an insulating material such as silicon nitride, silicon dioxide, a dielectric material, or the like.

It should be noted that the MEMS switch depicted throughout the present disclosure comprises a typical MEMS switch for illustrative purposes only, and is not to limit the present invention in any manner. Other shapes and configurations, such as circles, ovals, rectangles, and the like, of the flexible membrane 110 and the electrode 114 may be used within the spirit of the present invention. Additionally, the spacing, shape, number, and configuration of the insulating structures 116 are depicted for illustrative purposes only as a 3×4 array. The spacing, shape, number, and configuration of the insulating structures 116 are dependent, among other things, the flexibility of the chosen flexible membrane and the DC voltages used. Other spacing, shapes, numbers, and configurations of insulating structures 116 may be used without departing from the spirit of the present invention. Moreover, only a portion of the insulating posts may be used to prevent the flexible membrane 110 from contacting the electrode 114. For example, the insulating structures 116 may be positioned along a side of the electrode 114 protruding toward the center of the electrode 114, such that the flexible membrane 110 only contacts a portion of the insulating structures 116.

Moreover, a variety of configurations or constructions of supports 112 for the membrane 110 and a cantilever 810 can be employed, such as the upwardly extending sides of a well formed by an extension of a substrate 212 and a dielectric buffer layer 216, as shown in FIGS. 2, 3, 4, 5, 11, 12A, and 12B. In another configuration, metal posts 816 are formed on the dielectric buffer layer 216, integrally with a portion of the membrane 110 and the flexible portion of a cantilever 810, as shown in FIGS. 7, 8A, 8B, and 9. Other means of providing supports for the flexible membrane 110 will also be apparent and are contemplated by the invention.

Additionally, the inclusion of the insulating structures 116 is the preferred embodiment and allows for a more flexible membrane 110 that is less susceptible to failure due to repetitive flexes. Alternatively, the voltage, flexible membrane 110, and the spacing between the flexible membrane 110 and the electrode 114 may be adjusted such that the flexible membrane 110 is not capable of stretching or flexing to contact the electrode 114. This alternative embodiment, however, is not preferred because it is less mechanically robust and is more susceptible to failure.

Furthermore, the present disclosure discusses the invention in terms of a single MEMS switch. The present invention, however, may be used in a series or shunt configuration, or in combinations of series and shunt switches to configure a multi-throw switch. The use of the present invention in other configurations is considered known to a person of ordinary skill in the art upon a reading of the present disclosure.

Figure 2:
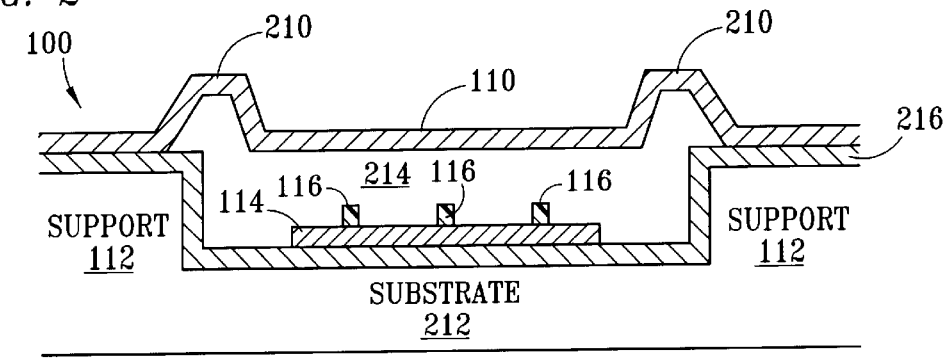
FIG. 2 illustrates a side view of a MEMS in an "OFF" state that embodies features of the present invention.

FIG. 2 is a side view of the MEMS illustrated in FIG. 1 to more clearly identify the components and their structural relationship. In one embodiment, the supports 112 are part of a substrate 212 (not shown in FIG. 1 for clarity) in which a cavity has been etched creating a gaseous gap 214 of approximately 3–6 microns intermediate the flexible membrane 110 and the electrode 114. The substrate 212 is preferably constructed of insulating materials such as ceramics (alumina, beryllium oxide), glass, or semiconductors (high-resistivity silicon, gallium arsenide, indium phosphide), or the like. Optionally, a dielectric buffer layer 216 is preferably placed on top of the substrate 212 to further insulate the flexible membrane 110, the electrode 114, the input/output connections, and other electrical components mounted to the substrate.

The electrode 114 is deposited in the bottom of the cavity 214 on top of the dielectric buffer layer 216, and is typically 0.5–3 microns thick. The dielectric structures 116, which are preferably 0.05–0.25 microns thick, are then deposited on the electrode 114. Preferably, the gaseous gap 214 comprises a gaseous substance, such as air, nitrogen, noble gases, and the like, that is inert and an effective insulator between electrode 114 and the flexible membrane 110.

Alternatively, supports 112 may be constructed upon a substrate from which the flexible membrane 110 may be suspended. In this alternative embodiment, the material, preferably a metal, is deposited upon the substrate 2–6 microns thick, or of a thickness greater than the electrode and the desired gaseous gap. The construction of this alternative embodiment will be apparent to one skilled in the art in light of this disclosure.

Furthermore, the flexible membrane 110 preferably comprises stress absorbers 210 to reduce the stress on the flexible membrane 110 when the flexible membrane 110 is pulled down, as discussed below with reference to FIG. 3. The stress absorbers are described in detail in U.S. Pat. No. 6,100,477 to Randall et al., entitled "Recessed Etch RF Micro-Electro-Mechanical Switch" and is incorporated by reference herein for all purposes.

Furthermore, the manufacturing techniques referred to herein, such as etching, additive and subtractive processes, and the like, are considered known to a person of ordinary skill in the art, and, therefore, will not be discussed in greater detail except insofar as is necessary to adequately describe the present invention.

Figure 3:
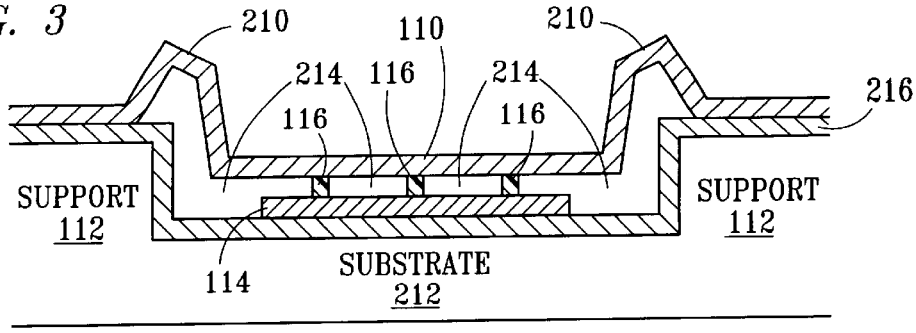
FIG. 3 illustrates a side view of a MEMS in an "ON" state that embodies features of the present invention.

FIG. 3 is a side view of the MEMS switch 100 in an actuated state, i.e., with a DC voltage applied to the electrode 114, causing the flexible membrane 110 to be attracted to the electrode 114. When a sufficient DC voltage is applied to the electrode 114, the gaseous gap 214 becomes charged and the flexible membrane 110 is pulled-down towards the electrode 114, possibly contacting at least a portion of one or more insulating structures 116. As discussed above, the insulating structures 116 prevent the flexible membrane 110 from contacting the electrode 114, creating a gaseous gap 214 that acts as a capacitance, which, when actuated, allows high-frequency signals to be transmitted between the RF In 120 and the RF Out 122 (as illustrated in FIG. 1). Upon removing the DC voltage from the electrode 114, the restoring forces of the flexible membrane 110 causes the flexible membrane 110 to return to the initial position illustrated in FIG. 2.

As will be appreciated by one skilled in the art, the use of a gaseous material for the gaseous gap 214 reduces the dielectric charging and trapping known to occur in many solid dielectric materials, reduces stiction by reducing the contact area, and reduces the need for smooth substrate, dielectric, and electrode surfaces. Thinner flexible membranes were generally preferred in the prior art, because, among other things, thinner flexible membranes make more complete contact with the underlying surface, thus providing a greater area of contact. In addition, thinner flexible membranes typically are smoother than thicker flexible membranes; thus reducing the wear and tear of the flexible membrane as it contacts the dielectric material, as well as enhancing the contact area through the reduction of the number of asperities or unevenness that would reduce the total contact area. Thinner flexible membranes, however, create a higher resistance in the RF path, decreasing the performance of the MEMS. Since, as noted above, the flexible membrane 110 contacts only the insulating structures 116, the flexible membrane 110 does not need to be as smooth and, therefore, may be thicker, which reduces the resistance in the RF path, increasing the switch performance.

Furthermore, the amount of voltage required to operate the switch is dependent upon, among other things, the properties of the flexible membrane 110. It is preferred that the flexible membrane react quickly, preferably within microseconds or tens of microseconds, to the application and/or removal of the DC voltage. Higher DC voltages will cause the flexible membrane 110 to react quicker, but is generally not available in many handheld or portable devices. Lower DC voltages, however, are not actuated as quickly and require a thinner flexible membrane 110. The precise configuration is dependent upon the intended use and can be determined by a person of ordinary skill in the art upon a reading of the present disclosure.

Figure 4:
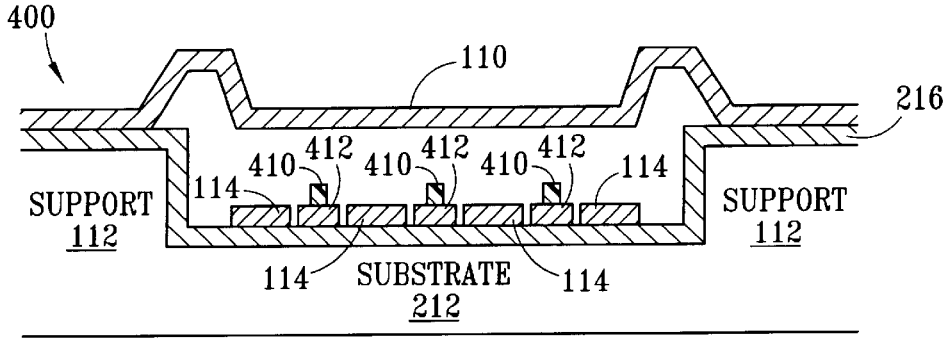
FIG. 4 illustrates another embodiment of the present invention in which the dielectric posts are electrically separated from the electrode.

FIG. 4 is an alternative embodiment of the present invention that further isolates the dielectric structures from the electrode. Generally, the embodiment illustrated in FIG. 4 further reduces the probability of the insulating structures 116 (shown in FIG. 2) trapping charges and affecting the performance of the MEMS switch 100 by electrically separating the insulating structures 116 from the electrode 114 (shown in FIGS. 2 and 3). Accordingly, reference numeral 400 generally designates a side view of a MEMS in which insulating structures 410 are deposited upon conductive structures 412, which are electrically separated from the electrode 114. The MEMS switch 400 is preferably manufactured similarly to the MEMS switch 100, except that the metal, i.e., the conductive material of the electrode 114, around each of the insulating structures 410 is removed such that the conductive structures 412 are not electrically coupled to the electrode 114.

Figure 5:
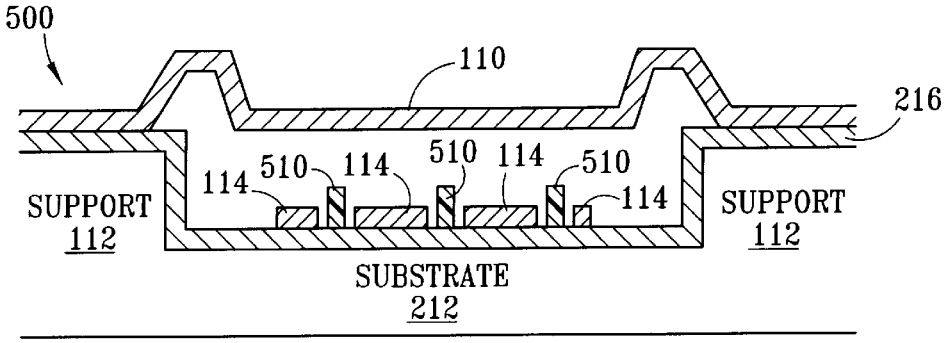
FIG. 5 illustrates yet another embodiment of the present invention in which the dielectric posts are electrically separated from the electrode.

FIG. 5 is yet another alternative embodiment that may further reduces the probability of the insulating structures trapping charges, affecting the performance of the MEMS switch. Accordingly, reference numeral 500 of FIG. 5 generally designates a side view of a MEMS switch in which insulating structures 510 are electrically isolated from the electrode 114. The insulating structures 510 are not coupled to the electrode or other conductive material, thereby further reducing the ability of the structures to trap and transmit a charge.

Preferably, the MEMS switch 500 is manufactured as described above with reference to FIG. 4, except that the area taken by the conductive structures 412 (FIG. 4) is also removed. Briefly, a conductive material is deposited upon the dielectric buffer layer, which was deposited upon the substrate as discussed above. The conductive material is etched to form the desired pattern of the electrode 114, specifically removing the conductive material from the locations that the insulating structures 510 are to reside. An insulating material is deposited upon the surface and etched to form the insulating structures 510. Therefore, the insulating structures 510 are deposited upon the dielectric buffer layer 216 and extends above the electrode 114, preferably by 0.05–0.25 microns.

Figure 6:
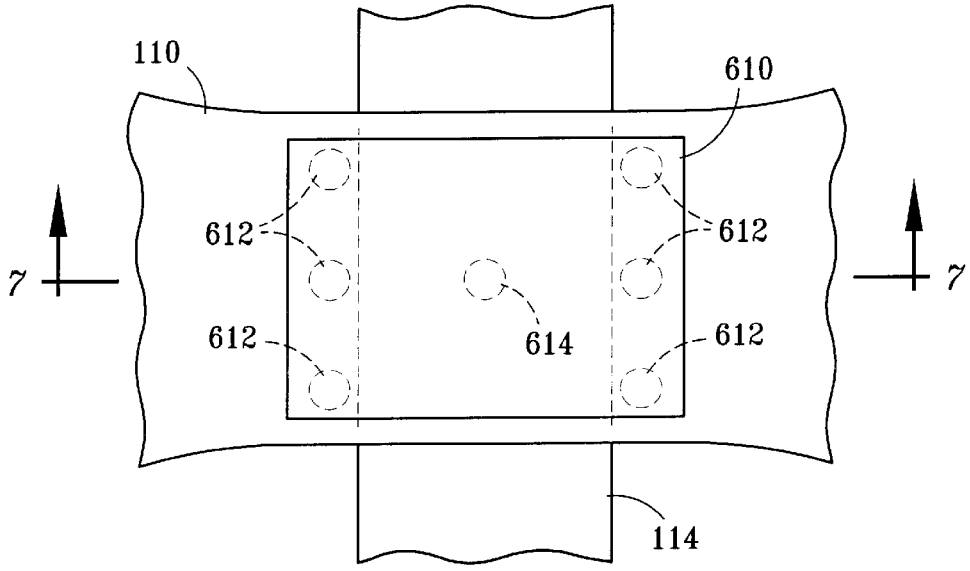
FIG. 6 illustrates a MEMS incorporating a stiffening member embodying features of the present invention.
Figure 7:
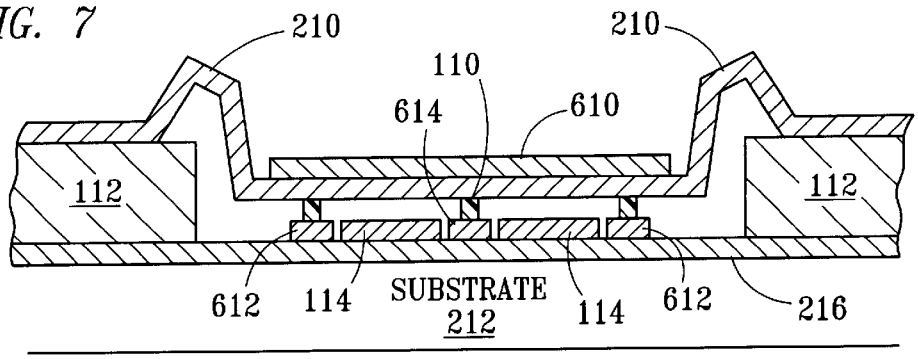
FIG. 7 illustrates a side view of a MEMS incorporating a stiffening member embodying features of the present invention.

FIGS. 6 and 7 are a top view and a side view, respectively, that illustrate an alternative embodiment of the present invention in which fewer insulating structures are used and are spaced further apart. Preferably, insulating structures 612 are positioned on either side of the electrode 114 in order to maximize the area of the exposed electrode. Accordingly, insulating structures 612 are positioned such that a stiffening member 610, which is coupled to and/or integrated in the flexible membrane 110, overlaps the insulating structures 612. The stiffening member 610 may be a separate component, such as dielectric layer, a metallic layer, or a combination thereof, coupled to the flexible membrane 110, or incorporated into the design and manufacturing of the flexible membrane, such that the flexible membrane comprises a thicker, less flexible portion or incorporates a stiffening component, such as ridges, corrugation, or the like.

Optionally, additional insulating structures, such as insulating structure 614, may be added as desired to insure that the flexible membrane does not come into contact with the electrode 114. The positions and shapes of the insulating structures 612 and 614 are provided for illustrative purposes only, and, therefore, should not limit the present invention in any manner. Other configurations and positions may be used as desired.

Figure 8A:
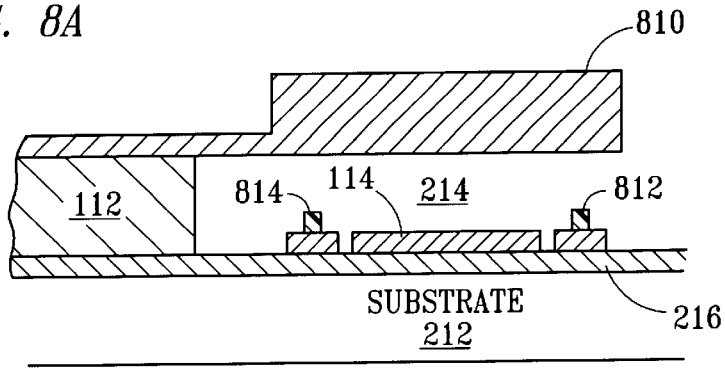
FIG. 8A illustrates a MEMS in an "OFF" state embodying features of the present invention that utilizes a cantilever.
Figure 9:
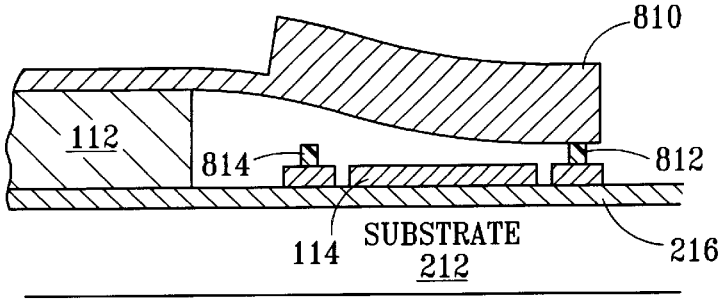
FIG. 9 illustrates a MEMS in an "ON" state embodying features of the present invention that utilizes a cantilever.

FIGS. 8A and 9 illustrate the "OFF" state and the "ON" state, respectively, of yet another embodiment of the present invention in which the flexible membrane is replaced with a cantilever. A cantilever 810 is suspended above the electrode 114 and one or more insulating structures 812. Applying a voltage to the electrode 114 causes the cantilever 810 to be pulled down towards the electrode 114. The cantilever 810 is prevented from contacting the electrode 114 by the insulating structures 812, causing the gaseous gap 214 to act as a capacitor. An optional insulating structure 814 may be positioned on the opposing side of the electrode 114 from the insulating structure 812 to ensure that the cantilever 810 does not contact the electrode 114. The optional insulating structure 814 also reduces the tension of the cantilever by not allowing it to flex further than is required to charge the gaseous gap 214.

It should be noted, however, that voltage breakdown may occur in the foregoing embodiments if the applied voltage exceeds the capability of the gas to stand it off. Voltage breakdown, generally referred to as a Townsend breakdown, occurs when emitted electrons strike molecules in the gas, which emit more electrons, and the process cascades until charges arc across the gap. In these situations, it may be desirable to utilize a metal with a high work function to increase the voltage breakdown of the switch. The use of a high-work-function metal, such as platinum, nickel, gold, and the like, reduces the affinity of electrons to be emitted that could eventually cause voltage breakdown.

Similarly, the gaps between the flexible membrane and the electrode, such as the gaseous gap 214, may be filled with gases that have high electronegativity to further reduce the possibility of the switch failing. Gases, such as sulpher hexafloride, carbon dioxide, and the like, exhibit high eltronegativity that reduces the affinity for a cascading breakdown after emitted electrons have struck the gas molecules.

Additionally, the DC control voltage may be varied such that the number of volts is reduced once the flexible membrane contacts one or more of the insulating structures. Generally, the amount of voltage required to pull down the flexible membrane to the insulating structures is greater than the amount of voltage required to maintain the flexible membrane in the pulled-down state, i.e., the "ON" position. Switch actuation voltages are typically 30–60 volts when the membrane is suspended in the initial "OFF" position. After the flexible membrane 110 has been pulled down, however, the electrical field is much stronger, and, therefore, the holding force is much stronger. Therefore, the applied voltage can be reduced to just above the required holding voltage, which ranges from 5–15 volts.

Figure 8B:
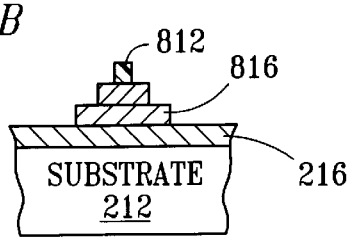
FIG. 8B illustrates a portion of the MEMS shown in FIG. 8A embodying features of the invention that control the actuating voltage.

FIG. 8B illustrates an optional configuration in which at least one of the structures 612, 812 and 814 may be connected to external circuitry to make an active control circuit that senses the touch of the flexible membrane 110, or the cantilever 810, onto the insulating structures 612, 812 or 814 to provide a mechanism to reduce the voltage after the switch has become actuated. For ease of illustration, the configuration of only insulating structure 812 is shown. Such a circuit would employ a metallic layer 816 deposited or otherwise positioned between at least the insulating structure 812 and the underlying dielectric buffer layer 216, to sense an electrical charge variation in the structure 812, upon contact with the cantilever 810. Once the flexible membrane 110 or cantilever 810 has been sensed in the "ON" position, the voltage can be immediately reduced from 30–60 volts to slightly above 5–15 volts. It should be noted that the voltages may vary dependent upon, among other things, the type of materials and gases, and the geometries that are used.

Figure 10:
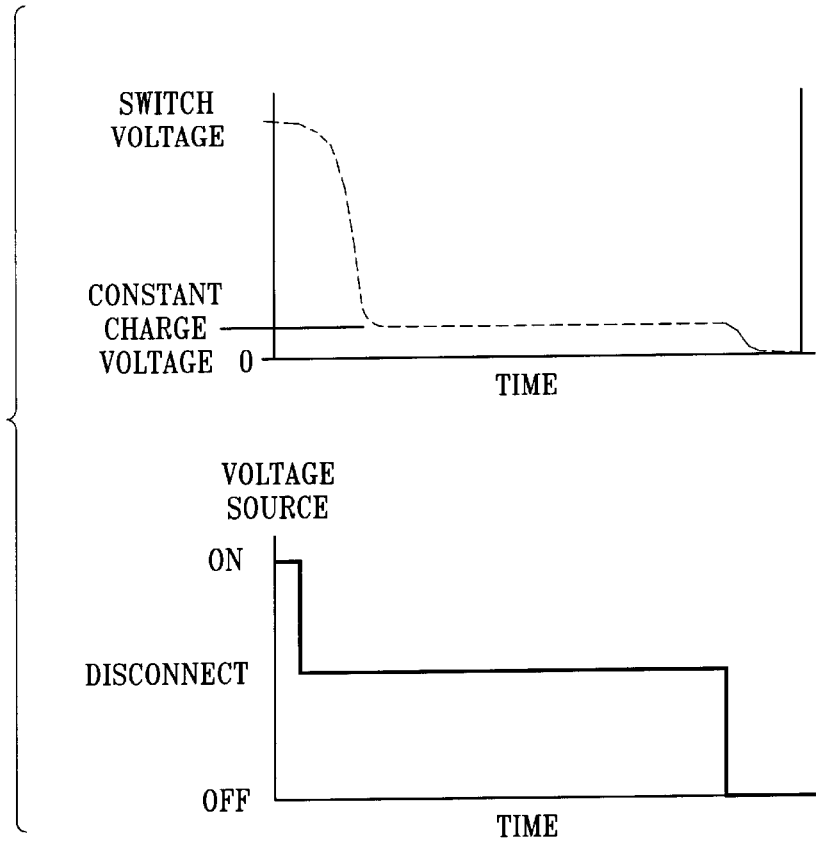
FIG. 10 illustrates the control voltage management scheme embodying features of the present invention that reduces applied voltage on the dielectric, reducing dielectric charging and voltage breakdown.

FIG. 10 illustrates yet another optional control voltage management scheme that may be utilized in conjunction with MEMS switch, such as those discussed in the present disclosure, as well as with other capacitive switches, such as the capacitive switch disclosed in U.S. Pat. No. 6,100,477, which is incorporated herein by reference for all purposes. Shown in the upper graph by a broken line is the switch voltage resulting over time as the switch actuates from the OFF to the ON positions and then is returned the OFF position. Shown in the lower graph by a solid line is the voltage source concomitantly applied to the switch over the same time period shown in the upper graph, during the OFF-ON-OFF actuation and return steps.

Referring to both graphs in FIG. 10, actuation of the switch is initiated by connecting a voltage source to the switch electrodes, illustrated by the solid line. Preferably, an actuation voltage is applied for a period of time, typically 0.10–1.0 microseconds, sufficient to charge the switch capacitance to its maximum value Q. This causes actuation of the switch, which in turn results in a drop in the switch voltage (broken line) to a lower level throughout the duration of the switch hold-down. This effect results from an increase in capacitance while maintaining a substantially fixed amount of charge on the switch plates. Upon charging the capacitance, the voltage source is disconnected, effectively leaving charge Q on the plates of the switch. Charge Q provides sufficient attraction between the flexible membrane 110 and the electrode 114 so as to cause the flexible membrane 110 to actuate onto the insulating structures 116, allowing RF energy to pass between the flexible membrane 110 and the electrode 114, in the switch ON state. As the electrode actuates and the capacitance between the flexible membrane 110 and the electrode 114 increases, the voltage level between the electrode 114 and flexible membrane 110 decreases proportionately. With the voltage source disconnected, there is no means available for the net charge to change and the product of capacitance and voltage remains constant. As a result, the voltage on the dielectric is minimized to the amount of voltage that is necessary to accomplish switching. Moreover, this control voltage management technique reduces or substantially eliminates the risk of electrical arching between the flexible membrane 110 and the electrode as they approach the ON state. The Switch is returned to the OFF position by reconnecting the DC voltage supply that has been switched to the OFF position or by discharging the applied charge Q.

Figure 11:
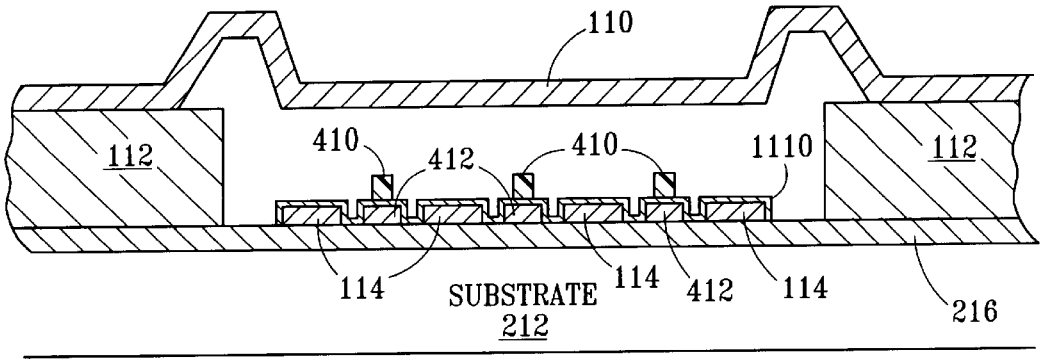
FIG. 11 illustrates a MEMS embodying features of the present invention that comprises an additional dielectric layer.

FIG. 11 illustrates yet another embodiment of the present invention that may reduce the likelihood of a voltage breakdown by depositing a thin dielectric or insulating layer onto the electrode. FIG. 11 represents the embodiment illustrated in FIG. 4 for illustrative purposes only, and, accordingly, the application of a thin dielectric layer onto the electrode may be used in conjunction with other embodiments, some of which are discussed within the present disclosure, such as the embodiments illustrated in FIGS. 1–9 and 11–12. The application of the thin dielectric layer with other embodiments is considered known to a person of ordinary skill in the art upon a reading of the present disclosure.

A thin dielectric layer 1110, preferably approximately 100 angstroms thick, may be applied over the full surface of the electrode, preferably after etching the electrode and prior to depositing the insulating structures 410, to further reduce the possibility of the MEMS switch failing. This layer, comprising a dielectric material, such as silicon nitride, silicon oxide, Teflon® or the like, hinders the ability of charges to traverse the gap, thereby reducing the likelihood of a voltage breakdown.

Figure 12A:
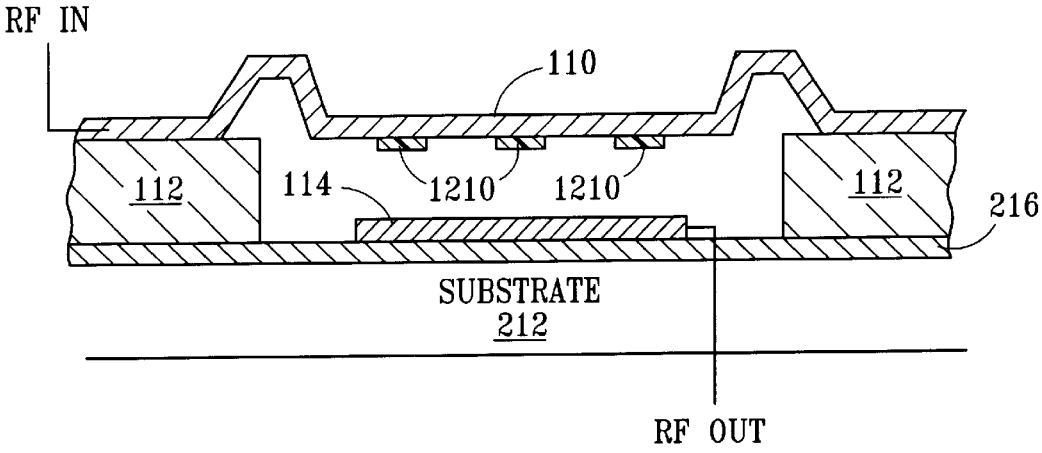
FIG. 12A illustrates a MEMS switch embodying features of the present invention that utilizes a dielectric post coupled to a flexible membrane.

FIG. 12A illustrates yet another embodiment of the present invention that utilizes dielectric structures coupled to the flexible membrane 110. FIG. 12A represents the embodiment illustrated in FIGS. 1–3 for illustrative purposes only, and, accordingly, coupling one or more dielectric structures to the flexible membrane 110 may be used in conjunction with other embodiments, some of which are discussed within the present disclosure, such as the embodiments illustrated in FIGS. 1–9 and 11.

Insulating structures 1210 are coupled to the flexible membrane 110. In a similar manner as the other embodiments discussed within the present disclosure, the insulating structures 1210 prevent the flexible membrane 110 from contacting the electrode 114, and create a gaseous gap that allows the transmission of high-frequency signals when charged.

Figure 12B:
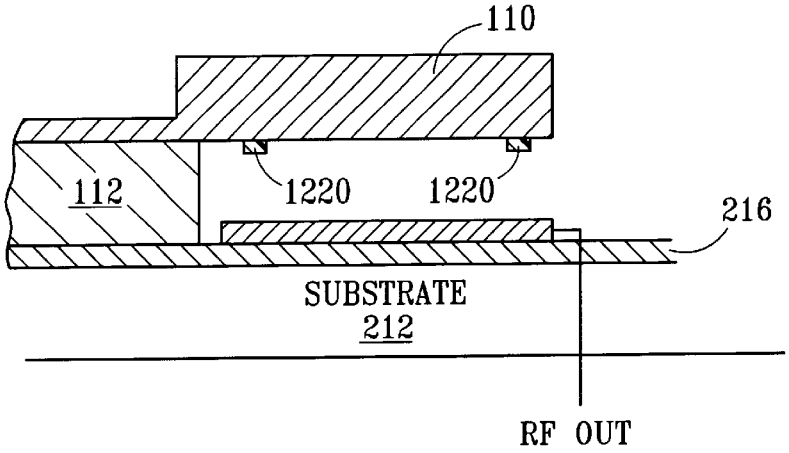
FIG. 12B illustrates a MEMS switch embodying features of the present invention that utilizes a dielectric post coupled to a cantilever.

FIG. 12B illustrates yet another embodiment of the present invention that utilizes dielectric structures coupled to the cantilever 810. FIG. 12B represents the embodiment illustrated in FIGS. 8A–9 for illustrative purposes only, and, accordingly, coupling one or more dielectric structures to the cantilever 810 may be used in conjunction with other embodiments, some of which are discussed within the present disclosure.

Insulating structures 1220 are coupled to the cantilever 810. In a similar manner as the other embodiments discussed within the present disclosure, the insulating structures 1220 prevent the cantilever 810 from contacting the electrode 114, and create a gaseous gap that allows the transmission of high-frequency signals when charged.

It is understood that the present invention can take many forms and embodiments. Accordingly, several variations may be made in the foregoing without departing from the spirit or the scope of the invention. For example, fixed conductors may be positioned on either side of a movable electrode, such that the switch electrically actuates in both directions and naturally release due to restoring forces in the other direction.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. An apparatus comprising:

a first electrode;

a second electrode configured to be displaced toward the first electrode in response to the application of a voltage differential with respect to the first electrode;

one or more insulating structures, wherein at least a portion of the insulating structures prevent the second electrode from contacting the first electrode; and a gaseous capacitive gap is formed and maintained between the first and second electrodes when the voltage differential is applied.

2. The apparatus of claim 1, further comprising means for discontinuing the application of the voltage differential after charging the gaseous capacitive gap.

3. The apparatus of claim 1, further comprising:

means for discontinuing the application of the voltage differential after charging the gaseous capacitive gap; and means for discharging the gaseous capacitive gap.

4. The apparatus of claim 1, wherein the second electrode comprises a flexible membrane suspended over the first electrode.

5. The apparatus of claim 1, wherein the second electrode comprises a cantilever.

6. An apparatus comprising:

one or more electrodes;

one or more insulating structures;

an electrically conductive member suspended above the electrodes, wherein at least a portion of the insulating structures prevent the electrically conductive member from contacting the electrodes, wherein the electrically conductive member is attracted to the electrodes when a voltage is applied to the electrode, and wherein a gaseous capacitive gap between the electrically conductive member and the electrodes is maintained when voltage is applied to the electrode.

7. The apparatus of claim 6, further comprising means for disconnecting the voltage after charging the gaseous capacitive gap.

8. The apparatus of claim 6, further comprising:

means for disconnecting the voltage after charging the gaseous capacitive gap; and means for discharging the gaseous capacitive gap.

9. The apparatus of claim 6, wherein the insulating structures comprise a dielectric material deposited on the electrodes.

10. The apparatus of claim 6, wherein the insulating structures are not electrically coupled to the electrodes.

11. The apparatus of claim 6, wherein the insulating structures comprise a dielectric material deposited on an electrically conductive material that is not electrically coupled to the electrodes.

12. The apparatus of claim 6, wherein the insulating structures are coupled to the electrically conductive member.

13. The apparatus of claim 12, wherein the electrically conductive member comprises a flexible membrane.

14. The apparatus of claim 12, wherein the electrically conductive member comprises a cantilever.

15. The apparatus of claim 13 or 14, wherein the insulating structures comprise a dielectric material coupled to the electrically conductive member.

16. The apparatus of claim 6, further comprising a dielectric layer deposited on the electrode.

17. The apparatus of claim 6, wherein the electrically conductive member comprises at least one of aluminum, gold, copper, platinum, and nickel.

18. The apparatus of claim 6, wherein the electrode comprises at least one of aluminum, gold, copper, platinum, and nickel.

19. The apparatus of claim 6, wherein the insulating structures comprise at least one of silicon nitride and silicon dioxide.

20. The apparatus of claim 6, wherein the gaseous capacitive gap comprises at least one of air, nitrogen, inert gasses, and noble gases.

21. An apparatus comprising:

a substrate with a cavity formed therein;

one or more electrodes placed within the cavity;

one or more insulating structures having a portion positioned above the-surface of the electrodes; and a conductive member having a flexible portion wherein the conductive member is suspended by the flexible portion above the electrodes, wherein a gaseous space is maintained intermediate the conductive member and the electrodes.

22. The apparatus of claim 21, wherein the insulating structures comprises a dielectric material deposited on the electrodes.

23. The apparatus of claim 21, wherein the insulating structures are not electrically coupled to the electrodes.

24. The apparatus of claim 21, wherein the insulating structures comprise a dielectric material deposited on a conductive material that is not electrically coupled to the electrodes.

25. The apparatus of claim 21, wherein the insulating structures are couple ed to the conductive member.

26. The apparatus of claim 21, further comprising a dielectric layer deposited on the electrodes.

27. The apparatus of claim 21, wherein the conductive member is either a flexible membrane or a cantilever.

28. A method of providing micro-electro-mechanical switching of high-frequency signals, the method comprising the steps of:

suspending a conductive, flexible membrane over an electrode, creating a switch;

actuating the switch by applying voltage to the electrode, wherein the voltage causes the flexible membrane to be attracted to the electrode, wherein the flexible membrane is prevented from contacting the electrode by at least a portion of one or more insulating structures, and wherein a gaseous capacitive gap is maintained between the flexible membrane and the electrode thereby allowing high-frequency signals to be transmitted to the electrode.

29. The method of claim 28, further comprising disconnecting the voltage when the gaseous capacitive gap is charged.

30. The method of claim 28, wherein the insulating structures comprise a dielectric material deposited on the electrodes.

31. The method of claim 28, wherein the insulating structures are not electrically coupled to the electrode.

32. The method of claim 28, wherein the insulating structures comprise a dielectric material deposited on a conductive material that is not electrically coupled to the electrodes.

33. The method of claim 28, wherein the insulating structures are coupled to the flexible membrane.

34. The method of claim 28, the electrodes comprise a conductive material covered by a dielectric layer.

35. A method of providing micro-electro-mechanical switching of high-frequency signals, the method comprising the steps of:

suspending a conductive cantilever having a flexible portion over an electrode, creating a switch;

actuating the switch by applying voltage to the electrode, wherein the voltage causes the flexible portion of the cantilever to flex the cantilever toward the electrode, wherein the cantilever is prevented from contacting the electrode by at least a portion of one or more insulating structures, and wherein a gaseous capacitive gap is maintained between the cantilever and the electrode thereby allowing high-frequency signals to be transmitted to the electrode.

36. The method of claim 35, further comprising disconnecting the voltage when the gaseous capacitive gap is charged.

37. The method of claim 35, wherein the insulating structures comprise a dielectric material deposited on the electrodes.

38. The method of claim 35, wherein the insulating structures are not electrically coupled to the electrode.

39. The method of claim 35, wherein the insulating structures comprise a dielectric material deposited on a conductive material that is not electrically coupled to the electrodes.

40. The method of claim 35, wherein the insulating structures are coupled to the cantilever.

41. The method of claim 35, the electrodes comprise a conductive material covered by a dielectric layer.

42. An apparatus, comprising:

a first electrically conductive member;

a second electrically conductive member; and a gaseous gap providing a capacitance formed and maintained between the first and second electrically conductive members, the gap allowing high-frequency signals to be transmitted between the first and second members.

43. The apparatus of claim 42, further comprising at least one insulating structure for separating the first and second electrically conductive members to maintain the gaseous capacitive gap.

44. The apparatus of claim 43, wherein the insulating structure does not retain sufficient dielectric charging to substantially degrade the capacitance of the gaseous gap.

* * * * *

UNITED STATES PATENT AND TRADEMARK OFFICE

CERTIFICATE OF CORRECTION

PATENT NO. : 6,608,268 B1
DATED : August 19, 2003
INVENTOR(S) : Goldsmith

It is certified that error appears in the above-identified patent and that said Letters Patent is hereby corrected as shown below:

Column 10,
Line 30, delete “couple ed” and insert -- coupled --.

Column 12,
Line 21, delete “substantially”.

Signed and Sealed this

Thirteenth Day of July, 2004

JON W. DUDAS
*Acting Director of the United States Patent and Trademark Office*